US009385496B2

(12) United States Patent
Okumura

(10) Patent No.: US 9,385,496 B2
(45) Date of Patent: Jul. 5, 2016

(54) GLOW PLUG TERMINAL AND GLOW PLUG

(75) Inventor: Yuki Okumura, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 609 days.

(21) Appl. No.: 13/876,523

(22) PCT Filed: Aug. 17, 2011

(86) PCT No.: PCT/JP2011/068629

§ 371 (c)(1),
(2), (4) Date: Mar. 28, 2013

(87) PCT Pub. No.: WO2012/046511

PCT Pub. Date: Apr. 12, 2012

(65) Prior Publication Data

US 2013/0180975 A1 Jul. 18, 2013

(30) Foreign Application Priority Data

Oct. 5, 2010 (JP) ..... 2010-225595
Oct. 5, 2010 (JP) ..... 2010-225599

(51) Int. Cl.

| | |
|---|---|
| ***H01R 13/04*** | (2006.01) |
| ***F23Q 7/22*** | (2006.01) |
| ***H01R 43/00*** | (2006.01) |
| ***F23Q 7/00*** | (2006.01) |

(52) U.S. Cl.

CPC ..... *H01R 43/00* (2013.01); *F23Q 7/001* (2013.01); *F23Q 7/22* (2013.01); *H01R 13/04* (2013.01); *Y10T 29/49204* (2015.01)

(58) Field of Classification Search

CPC ..... F23Q 7/001; F23Q 7/22
See application file for complete search history.

(56) References Cited

U.S. PATENT DOCUMENTS

2002/0162834 A1 11/2002 Asano et al. ..... 219/541
2002/0195443 A1* 12/2002 Tanaka ..... F23Q 7/001 219/541
2007/0241092 A1* 10/2007 Suzuki ..... F23Q 7/001 219/260
2010/0003841 A1* 1/2010 Metzler ..... H01R 13/052 439/125

FOREIGN PATENT DOCUMENTS

JP 2002-260827 9/2002 ..... H03B 3/02
JP 2005-308295 11/2005 ..... F23Q 7/00
JP 2005308295 A * 11/2005
JP 2009-041837 2/2009 ..... F23Q 7/00
JP 2009041837 A * 2/2009

OTHER PUBLICATIONS

Form PCT/ISA/210—Int'l Search Report (from corresponding Int'l Patent App. No. PCT/JP2011/068629—1 page.

* cited by examiner

*Primary Examiner* — David Angwin
*Assistant Examiner* — John J Norton
(74) *Attorney, Agent, or Firm* — Kusner & Jaffe

(57) ABSTRACT

A glow plug having a main body bracket, a heater, a center shaft, an insulator, an O-ring that is provided between the front end surface of the insulator and the main body bracket, and a pin terminal that is fitted to the rear end portion of the center shaft and used for supplying electricity from the outside. The pin terminal includes a small-diameter portion, a flange, and a large-diameter portion where an engagement portion and a fitting recess are formed. The large-diameter portion includes a crimp formation region, which is formed so as to have the even outer diameter and be capable of being crimped, in a range from the front end thereof to the front end of the engagement portion. A part of the crimping target portion forms a crimping portion that fixes the rear end portion of the center shaft by crimping.

12 Claims, 11 Drawing Sheets

PRIOR ART

GLOW PLUG TERMINAL AND GLOW PLUG

FIELD OF THE INVENTION

The present invention relates to a pin terminal for a glow plug and a glow plug.

BACKGROUND OF THE INVENTION

JP-A-2002-260827 discloses a conventionally known glow plug. As shown in FIG. 11, the glow plug includes a cylindrical housing 90, a heater 91 that is fixed in the housing 90 and includes a heat generating portion 91*a* protruding from the front end of the housing 90, a rod-like center shaft 92 which is disposed in the housing 90 and includes the rear end portion protruding from the rear end of the housing 90, and a pin terminal 93 that is fitted to the rear end portion of the center shaft 92 and is used to supply electricity to the heat generating portion 91*a* from the outside through the center shaft 92.

The heater 91 is a ceramic heater which is fitted into an outer cylinder 94 fitted to the front end of the housing 90 and made of a conductive metal and includes the heat generating portion 91*a* protruding from the front end of the outer cylinder 94 and the housing 90.

The ceramic heater 91 includes a rod-like insulating body 80 that contains $Si_3N_4$ as a main component, a U-shaped heat generating body 81 that is embedded in the front end portion of the insulating body 80 and contains WC as a main component, a first lead wire 82 having one end connected to one end of the heat generating body 81 and the other end exposed to a part of the outer peripheral surface of the insulating body 80, and a second lead wire 83 having one end connected to the other end of the heat generating body 81 and the other end exposed to the other part of the outer peripheral surface of the insulating body 80. The other end of the first lead wire 82 itself is connected to the outer cylinder 94, the other end of the second lead wire 83 itself is connected to a current-carrying coil 95, and the current-carrying coil 95 is connected to the center shaft 92. The front end portion of the insulating body 80, in which the heat generating body 81 is embedded, is the heat generating portion 91*a* of the ceramic heater 91.

The pin terminal 93 includes a small-diameter portion 93*a* that is formed at the rear end portion thereof and a large-diameter portion 93*b* that is formed at the front end portion thereof. The rear end surface of the small-diameter portion 93*a* has the shape of a curved surface. A first flange 93*c*, which comes into contact with an insulator 96 provided at the rear end portion of the housing 90 and made of an insulating material, is formed at the front end portion of the large-diameter portion 93*b*. Further, a second flange 93*d* is formed at the rear end portion of the large-diameter portion 93*b*, and an engagement portion 93*e* to which an engagement protrusion 85*a* of a cap 97 making current flow from the outside is locked is formed between the first and second flanges 93*c* and 93*d*.

When male threads 90*a* of the housing 90 are engaged with a cylinder head of a diesel engine, the heat generating portion 91*a* of the ceramic heater 91 is positioned in the combustion chamber of the diesel engine. Further, the housing 90 is grounded to the cylinder head, and the cap 97 connected to a battery is fitted to the pin terminal 93. The cap 97 includes a cup-shaped cap main body 85 and a conductive member 87. The conductive member 87 is fixed by a fixing member 86, which is provided inner side of the cap main body 85, so as to extend from the inner side toward an open portion. An engagement protrusion 85*a*, which protrudes inward, is formed on the inner portion of the cap main body 85 close to the open portion. The conductive member 87 is connected to a lead wire 88 that is connected to a battery.

When the cap 97 is fitted to the pin terminal 93, the engagement protrusion 85*a* of the cap main body 85 gets over the second flange 93*d* and is engaged with the engagement portion 93*e*. In this state, the conductive member 87 comes into contact with the surface of the small-diameter portion 93*a*.

Accordingly, a voltage is applied between the housing 90, the outer cylinder 94 and the first lead wire 82, the pin terminal 93, the center shaft 92, and the current-carrying coil 95 and the second lead wire 83, so that the heat generating portion 91*a* of the ceramic heater 91 generates heat by the heat generating body 81. In so doing, the diesel engine starts.

However, the pin terminal in the related art includes the first flange formed at the front end portion of the large-diameter portion and the second flange formed at the rear end of the large-diameter portion. Accordingly, in the pin terminal, the crimp formation region, which is formed so as to have the even outer diameter and be capable of being crimped, is limited between the first and second flanges and is short. For this reason, since it is difficult to solidly join the center shaft to the pin terminal by the short crimp formation region, the joint strength between the center shaft and the pin terminal should be ensured by employing a slightly long center shaft. For this reason, in the pin terminal, the reduction in the amount of material has been insufficient and the reduction in weight has been insufficient. Further, since the glow plug also employs the pin terminal and employs a slightly long center shaft, the reduction in the amount of material is insufficient and the reduction in weight is insufficient.

SUMMARY OF THE INVENTION

The present invention has been made in consideration of the above-mentioned circumstances. An advantage of the invention is a pin terminal that can be joined to a center shaft with high joint strength and that achieves a reduction in the amount of material and weight of a glow plug. Further, another advantage of the present invention is a glow plug that provides excellent durability through the joining between a center shaft and a pin terminal with high joint strength and can achieve a reduction in the amount of material and weight.

A pin terminal for a glow plug of the present invention comprises:

a small-diameter portion which has a shaft shape extending in an axial direction and is to be connected to a conductive member for supplying electric power from an outside;

a flange that is formed integrally with a front end of the small-diameter portion and is formed so as to have an outer diameter larger than an outer diameter of the small-diameter portion;

a cylindrical large-diameter portion that is formed integrally with a front end of the flange so as to be shorter than the small-diameter portion in the axial direction, is formed so as to have an outer diameter larger than the outer diameter of the small-diameter portion and smaller than the outer diameter of the flange, and includes a fitting recess formed therein in a radial direction so as to be recessed toward a rear end of the large-diameter portion from a front end of the large-diameter portion in the axial direction; and an engagement portion which is positioned between a maximum diameter position of the flange and the large-diameter portion and has an outer diameter gradually reduced toward the large-diameter portion, wherein the large-diameter portion includes a crimp formation region which is formed in a range from a front end of the large-diameter portion to a front end of the engagement portion so as to have the even outer diameter and be capable of being crimped. (claim 1)

The first flange 93*c*, which has been formed at the pin terminal 93 in the related art (see FIG. 11), is not formed at the pin terminal for a glow plug of the invention. Accordingly, in the pin terminal, the overall length thereof is maintained, that is, the compatibility with the cap fitted to the pin terminal is maintained and the length of the crimp formation region, which is formed so as to have the even diameter and can be crimped, is large. For this reason, the center shaft and the pin terminal are easily and solidly joined to each other at the long crimp formation region, and a slightly short center shaft can be employed. Accordingly, a reduction in the amount of material and weight can also be achieved in the pin terminal. Further, since the glow plug also employs the pin terminal and a slightly short center shaft, the glow plug can achieve a reduction in the amount of material and weight.

Meanwhile, as for the operation of the first flange 93*c* of the pin terminal 93 in the related art (see FIG. 11), at first, it was considered that the first flange 93*c* can sufficiently press the insulator 96 by increasing the contact area between the first flange 93*c* and the rear end of the insulator 96. Further, it was considered that an O-ring (not shown) provided between the front end surface of the insulator 96 and the housing 90 is elastically deformed into a uniform shape and can improve the insulation property between the center shaft 92 and the housing 90 when the first flange 93*c* sufficiently presses the insulator 96. However, according to a study conducted by the inventor, as for the pin terminal 93, it was found that an insulation effect of the O-ring also can be provided since the insulator 96 can be sufficiently pressed even though the contact area between the first flange and the rear end of the insulator 96 is not increased by the first flange 93*c* as in the related art. That is, difference is not generated between the insulation performance of the glow plug including the pin terminal of the invention and the insulation performance of the glow plug in the related art including the pin terminal 93 on which the first flange 93*c* has been formed.

Accordingly, the pin terminal for a glow plug of the invention can be joined to the center shaft with high joint strength and also can achieve the reduction in the amount of material and weight of the glow plug. Since the glow plug includes the pin terminal, the glow plug provides excellent durability at a low price.

It is possible to manufacture the pin terminal for a glow plug of the invention by the plastic working or cutting of a workpiece made of conductive metal. Further, the small-diameter portion, the flange, the large-diameter portion, and the engagement portion of the pin terminal may be formed by plastic working and the fitting recess may be formed by cutting. If the pin terminal is manufactured by only the plastic working of the workpiece made of conductive metal, swarf of the workpiece is not generated during working and it is possible to achieve a reduction in manufacturing cost by saving resources. Accordingly, it is preferable that the pin terminal be manufactured by only the plastic working of the workpiece.

The fact that the crimp formation region is formed so as to have the even outer diameter does not mean that the outer diameter is exactly constant, and also includes a case where the outer diameter is not constant within a certain range, that is, the outer diameter is substantially constant as long as the crimp formation region can be crimped. Since crimping is working that is performed on a cylindrical portion having a constant outer diameter, it is not possible to perform crimping if there is a diameter difference corresponding to the first flange 93*c* in the related art. If a diameter difference is 0.2 mm or less, it may be considered that the outer diameter is constant in the invention.

It is preferable that a diameter of a front end surface of the large-diameter portion is smaller than that of a rear end surface of an insulating member which is a component of the glow plug. (Claim 2) In this case, it is possible to very reliably prevent current from leaking to the housing or the like from the pin terminal.

It is preferable that the fitting recess includes an inner peripheral surface that extends from the front end of the large-diameter portion toward the rear end of the large-diameter portion, and an upper bottom surface that continues to a rear end of the inner peripheral surface and is positioned inside the engagement portion or the flange in a radial direction of the engagement portion or the flange. (Claim 3) In this case, it is possible to position the rear end portion of the center shaft, which is fitted to the fitting recess, at the rear end side of the crimp formation region. For this reason, since crimping is performed at the front end side with respect to the rear end portion of the center shaft in the glow plug including the pin terminal, it is possible to more effectively prevent a load from being concentrated on the rear end portion of the center shaft. Accordingly, the durability of the center shaft itself is improved and the durability of the glow plug itself is also improved. Meanwhile, the upper bottom surface means a surface forming the upper bottom of the fitting recess and a region corresponding to a certain range that includes this surface.

According to confirmation by the inventor, when a flange is formed through plastic deformation of the workpiece, distortion or the like easily occurs on the upper bottom surface of the fitting recess formed at the workpiece by the influence of the plastic deformation. Accordingly, wrinkles and the like, which are caused by distortion, are easily formed on the upper bottom surface. Meanwhile, plating is performed on the pin terminal for a glow plug in terms of the protection of the surface of the pin terminal and the like. For this reason, if distortion occurs on the upper bottom surface, cleaning liquid and the like used in the plating remains on the wrinkles and the like of the upper bottom surface, so that the quality of the plating of the fitting recess easily deteriorates. Further, rust and the like are easily generated on the upper bottom surface by the influence of the remaining cleaning liquid and the like. For these reasons, the quality of the pin terminal easily deteriorates.

It is preferable that the upper bottom surface has a tapered shape where a diameter of the upper bottom surface is reduced toward a rear end thereof. (Claim 4) Since the upper bottom surface has a tapered shape where the diameter of the upper bottom surface is reduced toward the rear end as described above, the thickness of the periphery of the upper bottom surface of the workpiece is increased. Accordingly, it is difficult for the upper bottom surface to be deformed even by plastic deformation when the flange is formed, and it is difficult for distortion or the like to occur on the upper bottom surface. For this reason, it is difficult for cleaning liquid or the like to remain on the upper bottom surface, so that plating is preferably performed on the fitting recess. Further, it is also difficult for rust or the like to occur on the upper bottom surface. For these reasons, the pin terminal has high quality.

It is preferable that the upper bottom surface is positioned at a side of the front end of the flange with respect to the maximum diameter position of the flange. (Claim 5) The magnitude of the plastic deformation of the workpiece, when the flange is formed through plastic deformation, reaches a maximum at the maximum diameter position of the flange.

For this reason, if the upper bottom surface of the fitting recess is positioned at a side of the front end with respect to the maximum diameter position of the flange, it is possible to further reduce the influence of the plastic deformation on the upper bottom surface. Accordingly, it is more difficult for the deformation of the upper bottom surface caused by plastic deformation to occur, so that the pin terminal has higher quality.

The flange may include a first cylindrical surface that is positioned close to the small-diameter portion and has a diameter larger than the diameter of the small-diameter portion, a convex curved surface which is connected to the first cylindrical surface and of which a cross-section in the axial direction forms an arc and a cross-section in a direction perpendicular to the axial direction has a circular shape, and a second cylindrical surface that is connected to the convex curved surface and has the same diameter as the diameter of the first cylindrical surface. It is preferable that a step is formed on the convex curved surface at a side of the second cylindrical surface with respect to the maximum diameter position. (Claim 6)

In this case, the cap is easily fitted to the pin terminal due to the first cylindrical surface and the convex curved surface. Further, it is difficult for the cap to be taken out from the pin terminal due to the second cylindrical surface. In this case, it is possible to preferably lock the cap to the engagement portion by using the step. For this reason, for example, even though the cap is deviated from the engagement portion due to vibration and the like and is moved in the direction where the cap is taken out from the pin terminal, the cap is caught by the step. Accordingly, the cap is preferably prevented from being moved toward the rear end from the step. Furthermore, the step itself may function as an engagement portion. Meanwhile, the step may be included in the engagement portion, and the step itself may be used as a engagement portion. In addition, the step may be simultaneously formed when the flange is formed through plastic working, and may be formed by cutting a formed flange.

It is preferable that the flange includes a cylindrical first cylindrical surface that is positioned close to the small-diameter portion and has a diameter larger than the diameter of the small-diameter portion, a convex curved surface which is connected to the first cylindrical surface and of which a cross-section in the axial direction forms an arc and a cross-section in a direction perpendicular to a shaft has a circular shape, and a cylindrical second cylindrical surface that is connected to the convex curved surface and has the same diameter as the diameter of the first cylindrical surface. (Claim 7) In this case, the cap is more easily fitted to the pin terminal due to the first cylindrical surface and the tapered surface. Further, it is difficult for the cap to be taken out from the pin terminal due to the second disc surface.

A glow plug of the present invention comprises:

a cylindrical housing;

a heater that is fixed in the housing and includes a heat generating portion protruding from a front end of the housing;

a rod-like center shaft which is disposed in the housing and includes a rear end portion protruding from a rear end of the housing;

an insulating member which is provided at the rear end of the housing and into which the center shaft is inserted; and a pin terminal that is fitted to the rear end portion of the center shaft and used to supply an electricity to the heat generating portion from an outside through the center shaft, wherein the pin terminal includes:

a small-diameter portion which has the shaft shape extending in an axial direction and is to be connected to a conductive member for supplying electric power from the outside;

a flange that is formed integrally with a front end of the small-diameter portion and is formed so as to have an outer diameter larger than an outer diameter of the small-diameter portion;

a cylindrical large-diameter portion that is formed integrally with a front end of the flange so as to be shorter than the small-diameter portion in the axial direction, is formed so as to have an outer diameter larger than the outer diameter of the small-diameter portion and smaller than the outer diameter of the flange, and includes a fitting recess formed therein in a radial direction so as to be recessed toward a rear end of the large-diameter portion from a front end of the large-diameter portion in the axial direction; and an engagement portion which is positioned between a maximum diameter position of the flange and the large-diameter portion and has an outer diameter gradually reduced toward the large-diameter portion, wherein the large-diameter portion includes a crimp formation region, which is formed in a range from a front end of the large-diameter portion to a front end of the engagement portion so as to have the even outer diameter and be capable of being crimped, and wherein a part of the crimp formation region forms a crimping portion that fixes the rear end portion of the center shaft by crimping. (Claim 8)

The glow plug of the invention includes the pin terminal of the invention. For this reason, the glow plug provides excellent durability through the joining between the center shaft and the pin terminal with high joint strength and can achieve a reduction in the amount of material and weight. Accordingly, the glow plug provides excellent durability at a low price.

It is preferable that the crimping portion has a length that exceeds a half of an overall length of the crimp formation region in the axial direction. (Claim 9) In this case, the joint strength between the center shaft and the pin terminal is high as compared to a common product where the length of a crimping portion is equal to or smaller than the half of the overall length of a crimp formation region in the axial direction. Accordingly, the glow plug reliably provides excellent durability.

It is preferable that the crimping portion is positioned at a side of a front end of the crimp formation region with respect to a middle of the crimp formation region in the axial direction. (Claim 10) In this case, in the glow plug, crimping is performed on the pin terminal at the position that is close to the front end of the large-diameter portion. For this reason, in the glow plug, it is possible to reduce a load applied to the rear end portion of the center shaft. Accordingly, the durability of the glow plug is further improved.

The fitting recess may include an inner peripheral surface that extends from a front end of the large-diameter portion toward a rear end of the large-diameter portion, and an upper bottom surface that continues to a rear end of the inner peripheral surface and is positioned inside the engagement portion or the flange in the radial direction of the engagement portion or the flange. Further, the upper bottom surface may have a tapered shape where a diameter of the upper bottom surface is reduced toward a rear end. Furthermore, the center shaft may have a tapered rear end portion having a diameter reduced toward a rear end. Moreover, it is preferable that the rear end portion of the center shaft be positioned inside the upper bottom surface (claim 11).

In this case, since the rear end portion of the center shaft has the above-mentioned tapered shape, the rear end of the center shaft is easily inserted into the fitting recess. Further, the rear end of the center shaft inserted into the fitting recess reaches the upper bottom surface along the inner peripheral surface. In this case, since the upper bottom surface has a tapered shape where a diameter of the upper bottom surface is reduced toward the rear end, it is difficult for the upper bottom surface to be deformed even by plastic deformation as described above. Accordingly, it is difficult for distortion or the like to occur on the upper bottom surface. For this reason, since it is difficult for the fitting recess to be deformed, it is possible to preferably join the center shaft to the pin terminal with high joint strength so that the rear end portion of the center shaft is positioned inside the upper bottom surface. Furthermore, since it is difficult for distortion or the like to occur on the upper bottom surface, plating is preferably performed on the fitting recess and it is also difficult for rust or the like to occur on the upper bottom surface. For these reasons, the durability of the glow plug is further improved.

Here, the upper bottom surface means a surface forming the upper bottom of the fitting recess and a region corresponding to a certain range that includes this surface. For this reason, a fact that the rear end portion of the center shaft is positioned inside the upper bottom surface means a state where the rear end portion of the center shaft comes into contact with a surface forming the upper bottom or the rear end portion of the center shaft approaches the surface to the degree equivalent to this (see FIG. 10).

Further, it is preferable that the upper bottom surface be positioned at a side of the front end with respect to the maximum diameter position of the flange (claim 12). It is difficult for the deformation of the upper bottom surface, which is caused by plastic deformation, to occur, so that it is possible to more preferably join the center shaft to the pin terminal with high joint strength. Furthermore, since the upper bottom surface is positioned at the side of the front end with respect to the maximum diameter position of the flange as described above, the depth of the fitting recess is relatively reduced. Accordingly, it is possible to make the rear end of the center shaft short. For this reason, the whole center shaft can be formed to be short, so that it is possible to reduce the manufacturing cost of the glow plug. Meanwhile, even when the depth of the fitting recess is reduced and the rear end of the center shaft becomes short as described above, the joint strength between the center shaft and the pin terminal is maintained high since the crimping portion has a sufficient length as described above.

In the pin terminal for a glow plug of the invention and a glow plug including the pin terminal, the center shaft and the pin terminal can be joined to each other with high joint strength and a reduction in the amount of material and weight of a glow plug can be achieved. For this reason, the glow plug including the pin terminal provides excellent durability at a low price.

BRIEF DESCRIPTION OF THE DRAWINGS

FIG. 2 shows a partial cross-sectional view and a partial enlarged view of a pin terminal of a glow plug of the embodiment that is not yet assembled.

DETAILED DESCRIPTION OF PREFERRED EMBODIMENTS

An embodiment of the invention will be described below with reference to the drawings.

Figure 1:
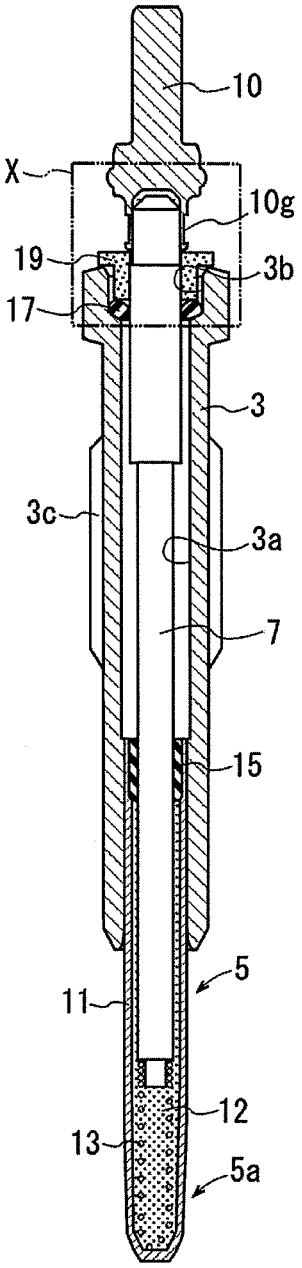
FIG. 1 is a cross-sectional view of a glow plug of an embodiment.

As shown in FIG. 1, a glow plug of an embodiment includes a main body bracket 3 as a cylindrical housing, a heater 5 that is fixed in the main body bracket 3 and includes a heat generating portion 5*a* protruding from a front end of the main body bracket 3, a rod-like center shaft 7 which is disposed in the main body bracket 3 and includes a rear end portion protruding from a rear end of the main body bracket 3, and a pin terminal 10 that is fitted to the rear end portion of the center shaft 7 and is used to apply an electricity to the heat generating portion 5*a* from the outside through the center shaft 7.

The heater 5 includes a heat generating tube 11 having a front end being closed. The heat generating tube 11 has the shape of a cylinder extending in the axial direction, and is fixed in the main body bracket 3 so that current can flow while a front end portion of the heat generating tube 11 protrudes from the front end portion of the main body bracket 3. A front end of the center shaft 7 is positioned in the heat generating tube 11, and a rear end of the center shaft 7 protrudes from the rear end of the main body bracket 3. Insulating powder 12 containing MgO as a main component and a heat generating coil 13 are housed in the heat generating tube 11. A front end portion of the heat generating coil 13 is joined to the front end portion of the heat generating tube 11, and a rear end portion of the heat generating coil 13 is joined to a front end portion of the center shaft 7. The heat generating tube 11, the insulating powder 12, and the heat generating coil 13 form the heater 5. Further, the front end portion of the heat generating tube 11 in which the heat generating coil 13 is housed together with the insulating powder 12 is the heat generating portion 5*a* of the heater 5.

An insulating body 15, which is formed of rubber packing, is fixed to the middle portion of the outer peripheral surface of the center shaft 7 and an open end of the heat generating tube 11 is crimped around the insulating body 15, so that the heat generating tube 11 is fixed to the center shaft 7 so as to be insulated from the center shaft 7.

Further, a large-diameter hole 3*b* of a shaft hole 3*a*, which has the largest diameter, is formed at the rear end portion of the main body bracket 3, and an O-ring 17 and an annular insulator 19 made of an insulating material are placed at a stepped portion that faces the rear end and is formed between the shaft hole 3*a* and the large-diameter hole 3*b*. The center shaft 7 is inserted into the respective inner peripheries of the O-ring 17 and the insulator 19. The O-ring 17 and the insulator 19 correspond to an insulating member. Meanwhile, the insulating member may be formed by integrating the O-ring 17 with the insulator 19. Further, the insulating member may be formed by the combination of three or more components, and the insulating member may be formed of a single component.

Figure 2A:
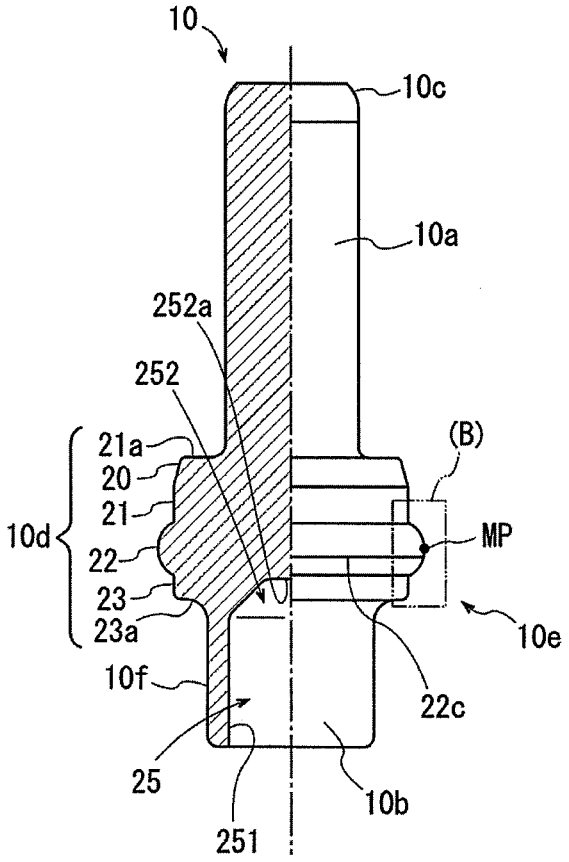
FIG. 2A is a partial cross-sectional view showing the entire pin terminal.

As shown in FIG. 2A, the pin terminal 10 includes a small-diameter portion 10*a* close to a rear end and a large-diameter portion 10*b* close to a front end. The small-diameter portion 10*a* has the shaft shape extending in the axial direction. A curved surface 10*c* is formed on the outer periphery of a rear end surface of the small-diameter portion 10*a*. Further, a flange 10*d* is formed between the small-diameter portion 10*a* and the large-diameter portion 10*b*. The pin terminal 10 has a shape having a diameter gradually reduced from the flange 10*d* toward the large-diameter portion 10*b*. Furthermore, the small-diameter portion 10*a* and the large-diameter portion 10*b* are separated from each other by the flange 10*d*.

The flange 10*d* includes a first cylindrical surface 21, a convex curved surface 22, and a second cylindrical surface 23. The first cylindrical surface 21 is positioned close to the small-diameter portion 10*a* and has the shape of a cylinder having the diameter which is larger than the diameter of the small-diameter portion 10*a*. The convex curved surface 22 is connected to the first cylindrical surface 21, the cross-section of the convex curved surface in the axial direction forms an arc, and the cross-section of the convex curved surface in a direction perpendicular to the axial direction has a circular shape. The second cylindrical surface 23 is connected to the convex curved surface 22, and has the shape of a cylinder having the diameter which is the same as the diameter of the first cylindrical surface 21.

In addition, the flange 10*d* includes a first disc surface 21*a*, a tapered surface 20, and a second disc surface 23*a*. The first disc surface 21*a* is connected to the small-diameter portion 10*a*, and extends in the direction perpendicular to the axial direction. The tapered surface 20 is connected to the first cylindrical surface 21 at the front end portion thereof, and is connected to the first disc surface 21*a* at the rear end portion thereof. The tapered surface 20 is formed so that the rear end portion of the tapered surface has a small diameter. The second disc surface 23*a* connects the second cylindrical surface 23 to the large-diameter portion 10*b*, and extends in the direction perpendicular to the axial direction. Meanwhile, a connecting portion between the second disc surface 23*a* and the large-diameter portion 10*b* has an arc shape. Accordingly, the second disc surface 23*a* and the large-diameter portion 10*b* are smoothly connected to each other.

Figure 2B:
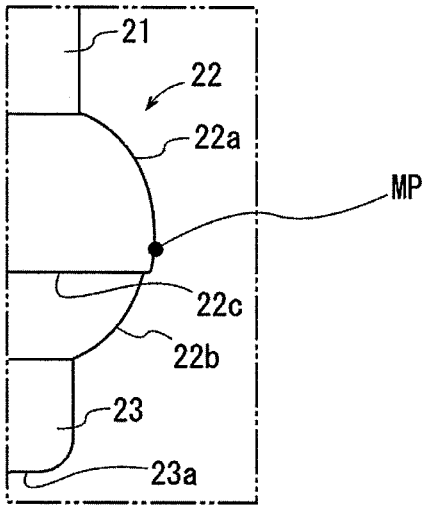
FIG. 2B is a partial enlarged view showing a convex curved surface.

Further, as shown in FIG. 2B, while a portion slightly at the side of the front end with respect to the maximum diameter position MP of the flange 10*d* be as a boundary, the convex curved surface 22 includes a first arc 22*a* that is formed toward the first cylindrical surface 21 from the portion slightly at the side of the front end with respect to the maximum diameter position MP and a second arc 22*b* that is formed toward the second cylindrical surface 23 from the portion slightly at the side of the front end with respect to the maximum diameter position MP. That is, a portion including the first arc 22*a* is the rear end portion of the convex curved surface 22, and a portion including the second arc 22*b* is the front end portion of the convex curved surface 22. Furthermore, a step 22*c* is formed at a boundary between the first arc 22*a* and the second arc 22*b*, that is, on the outer peripheral surface of the portion of the convex curved surface 22 that is slightly at the side of the front end with respect to the maximum diameter position MP. The second cylindrical surface 23 and the step 22*c* correspond to a engagement portion 10*e*. Meanwhile, the shape of the step 22*c* will be described in detail below.

Here, the engagement portion 10*e* may be formed between the maximum diameter position MP of the flange 10*d* and the large-diameter portion 10*b*, and is not limited to the second cylindrical surface 23 and the step 22*c* as described above. For example, the step 22*c*, the second cylindrical surface 23, and the second disc surface 23*a* may be used as the engagement portion 10*e*. Further, any one of the step 22*c*, the second cylindrical surface 23, and the second disc surface 23*a* may be used as the engagement portion 10*e*. Furthermore, the combination of the second cylindrical surface 23 and the second disc surface 23*a* may be used as the engagement portion 10*e*.

As shown in FIG. 2A, the large-diameter portion 10*b* is formed integrally with the front end of the small-diameter portion 10*a* and is formed so as to have an outer diameter larger than the outer diameter of the small-diameter portion 10*a* and smaller than the outer diameter of the flange 10*d*. Further, the diameter of the front end surface of the large-diameter portion 10*b* is smaller than the diameter of the rear end surface of the insulator 19 (see FIG. 10) to be described below.

Furthermore, in the pin terminal 10 which is not yet assembled, a range of from the front end of the large-diameter portion 10*b* to the front end of the engagement portion 10*e* have substantially the even outer diameter since being formed so as to have a diameter difference of 0.2 mm or less. Moreover, this range is a crimp formation region 10*f*.

In addition, a fitting recess 25 into which the center shaft 7 is fitted is formed at the front end surface of the large-diameter portion 10*b*. The fitting recess 25 includes an inner peripheral surface 251 and an upper bottom surface 252 that are formed in the pin terminal 10. The inner peripheral surface 251 extends from the front end of the large-diameter portion 10*b* toward the rear end of the large-diameter portion, and the upper bottom surface 252 continues to the rear end of the inner peripheral surface 251 and is positioned inside the flange 10*d* in the radial direction. The upper bottom surface 252 is a surface 252*a* forming the upper bottom of the fitting recess 25 and a region corresponding to a certain range that includes the surface 252*a*. Further, the upper bottom surface 252 has a tapered shape where the diameter of the upper bottom surface is reduced from the front end of the pin terminal 10 toward the rear end. Furthermore, the upper bottom surface 252 is positioned in the pin terminal 10 at the side of the front end with respect to the maximum diameter position MP of the flange 10*d*, more specifically, is positioned in the pin terminal 10 at a position corresponding to the second cylindrical surface 23.

Figure 3:
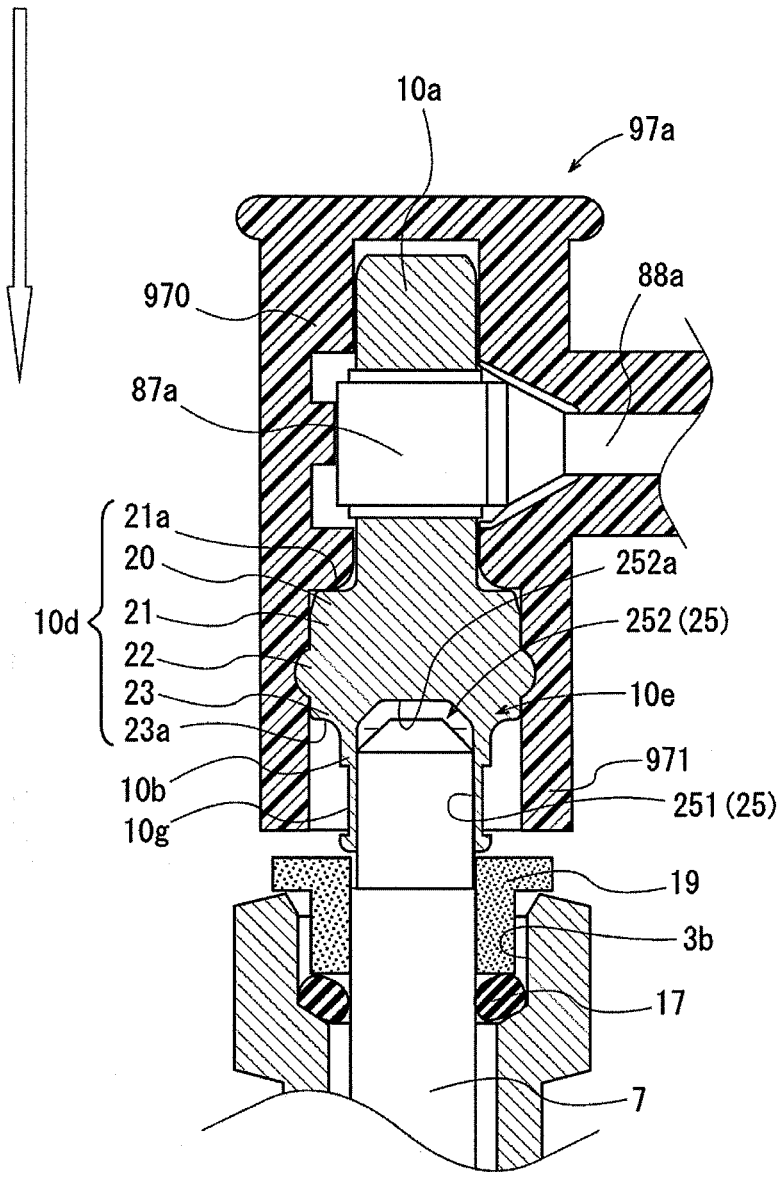
FIG. 3 is an enlarged cross-sectional view showing a state where a cap and the pin terminal of the glow plug of the embodiment are fitted to each other.

A cap 97*a*, which is used to apply an electricity to the pin terminal from the outside, is mounted on the pin terminal 10 as shown in FIG. 3. The cap 97*a* includes a cup-shaped cap main body 970 and a conductive member 87*a* that is fixed to the back side of the cap main body 970. The cap main body 970 is made of a resin. Further, a portion 971 to be locked is formed on the inside of the open portion of the cap main body 970. Meanwhile, the conductive member 87*a* is connected to a lead wire 88*a* that is connected to a battery (not shown).

In the manufacture of the glow plug, the pin terminal 10 is manufactured by the following respective steps.

First Step

Figure 4A:
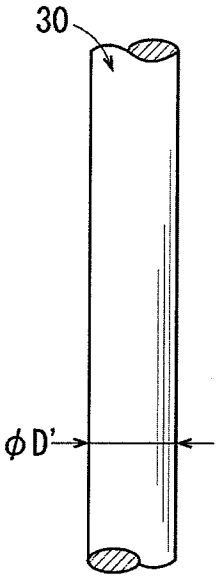
FIGS. 4A to 4E show side views of a workpiece at the end of respective steps of a manufacturing method of the embodiment.
Figure 4B:
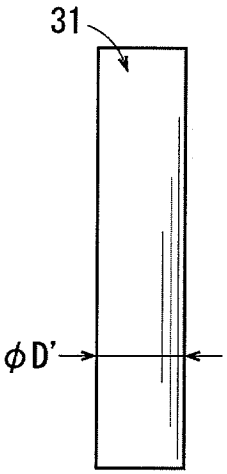

First, a rod 30, which has a diameter ϕD' and a circular cross-section and is made of steel as conductive metal, is prepared as shown in FIG. 4A. A first workpiece 31 having a predetermined length as shown in FIG. 4B is obtained by cutting the rod 30 in the direction perpendicular to the axial direction.

Second Step

Figure 5:
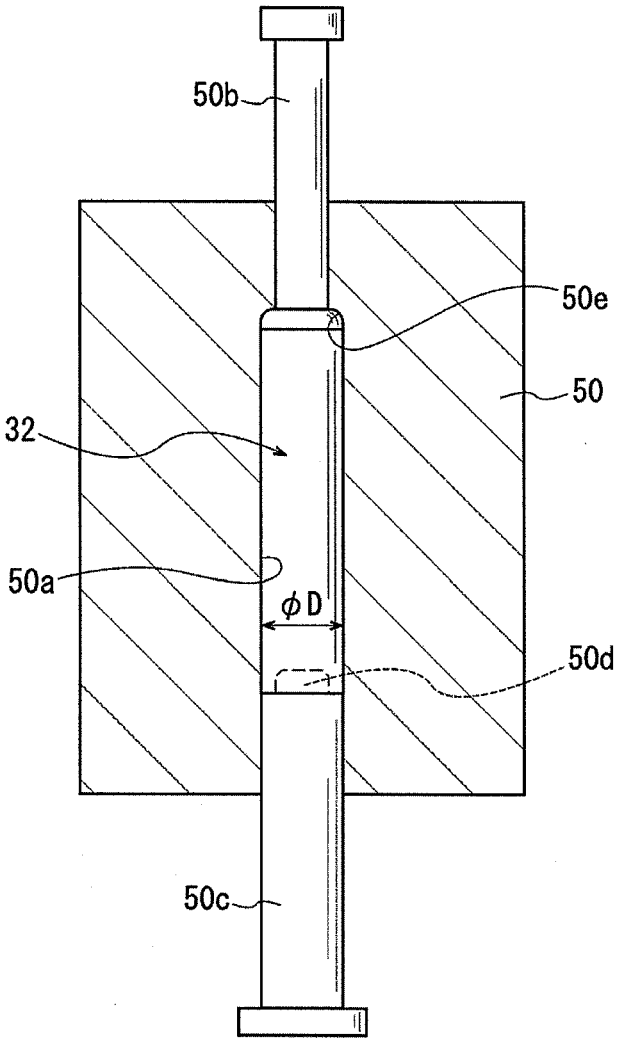
FIG. 5 is a cross-sectional view illustrating a second step of the manufacturing method of the embodiment.

An end surface adjusting die 50, which has a cavity 50*a* as shown in FIG. 5, is prepared. The inner diameter of the cavity 50*a* is denoted by ϕD, and is slightly larger than ϕD'. The ϕD is substantially the same as the outer diameter of the large-diameter portion 10*b* of the pin terminal 10 shown in FIG. 2.

As shown in FIG. 5, a curved surface 50*e* is formed at the upper end of the cavity 50*a*. Further, a kickout pin 50*b* is provided at the upper end of the cavity 50*a*, and a punch 50*c* is provided at the lower end of the cavity 50*a* so as to be capable of applying pressure in the cavity 50*a*. A protrusion 50*d* having a first height is formed on the upper end surface of the punch 50*c*. Meanwhile, the first height is a height corresponding to a first depth.

Further, the first workpiece 31 is conveyed into the cavity 50*a* of the end surface adjusting die 50, and pressure is applied to the first workpiece 31 by the punch 50*c*. Accordingly, the rear end surface of the first workpiece 31 comes into pressure contact with the kickout pin 50*b* and the curved surface 50*e*, and the first workpiece 31 is adjusted and subjected to plastic working.

Figure 4C:
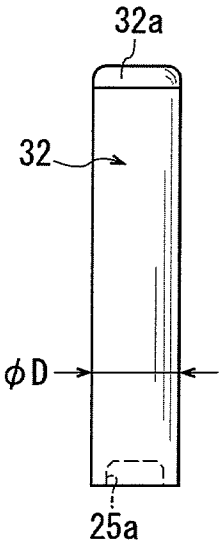

In this way, the first workpiece 31 is formed into a second workpiece 32 that includes a curved surface 32*a* at the rear end surface thereof as shown in FIG. 4C. For this reason, even though recesses and protrusions are formed on the rear end surface of the first workpiece or the end surface of the first workpiece is inclined when the first workpiece 31 is prepared, the recesses and protrusions do not expand by extruding or the like and the obtained second workpiece 32 is not unexpectedly deformed. Further, a first fitting recess 25*a* having the first depth is formed at the front end surface of the second workpiece 32 by the protrusion 50*d*.

After that, the punch 50*c* is moved down and the second workpiece 32 is taken out from the end surface adjusting die 50 by the kickout pin 50*b*.

Third Step

Figure 6:
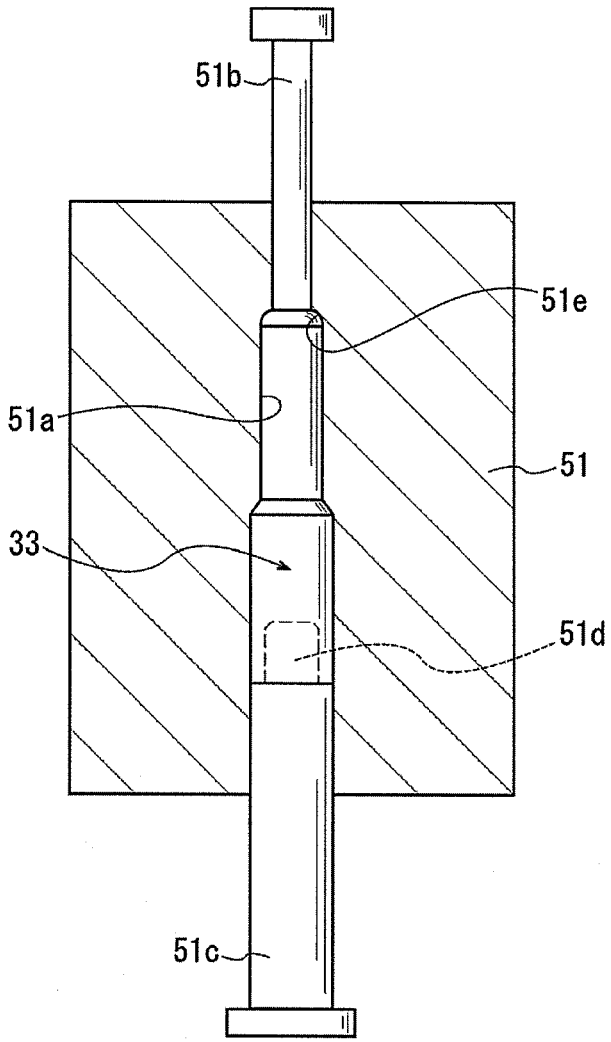
FIG. 6 is a cross-sectional view illustrating a third step of the manufacturing method of the embodiment.

Then, an extrusion die 51, which has a cavity 51*a* having the upper portion formed so as to have a small diameter as shown in FIG. 6, is prepared.

A curved surface 51*e* is formed at the upper end of the cavity 51*a*. Further, a kickout pin 51*b* is provided at the upper end of the cavity 51*a*, and a punch 51*c* is provided at the lower end of the cavity 51*a* so as to be capable of applying pressure in the cavity 51*a*. A protrusion 51*d*, which has a second height larger than the first height, is formed on the upper end surface of the punch 51*c*. Meanwhile, the second height is a height corresponding to a second depth.

Further, the second workpiece 32 is conveyed into the cavity 51*a* of the extrusion die 51 so that the curved surface 32*a* faces upward, and pressure is applied to the second workpiece 32 by the punch 51*c*. Accordingly, the rear end surface of the second workpiece 32 comes into pressure contact with the kickout pin 51*b* and the curved surface 51*e* again, and the second workpiece 32 is adjusted and subjected to plastic working.

Figure 4D:
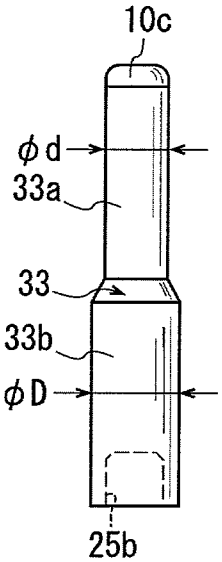

In this way, the second workpiece 32 is formed into a third workpiece 33 having the diameter which is reduced at the rear end portion thereof as shown in FIG. 4D. The rear end portion of the third workpiece 33 forms a small-diameter portion 33*a* having ϕd and the front end portion thereof forms a large-diameter portion 33*b* having ϕD larger than ϕd. The diameter of the curved surface 32*a* is reduced, so that the end surface of the small-diameter portion 33*a* is formed into the curved surface 10*c* corresponding to the product shape. Further, a second fitting recess 25*b*, which has the second depth larger than the first depth, is formed at the front end surface of the third workpiece 33 by the protrusion 51*d*. After that, the punch 51*c* is moved down and the third workpiece 33 is taken out from the extrusion die 51 by the kickout pin 51*b*.

Fourth Step

Figure 7:
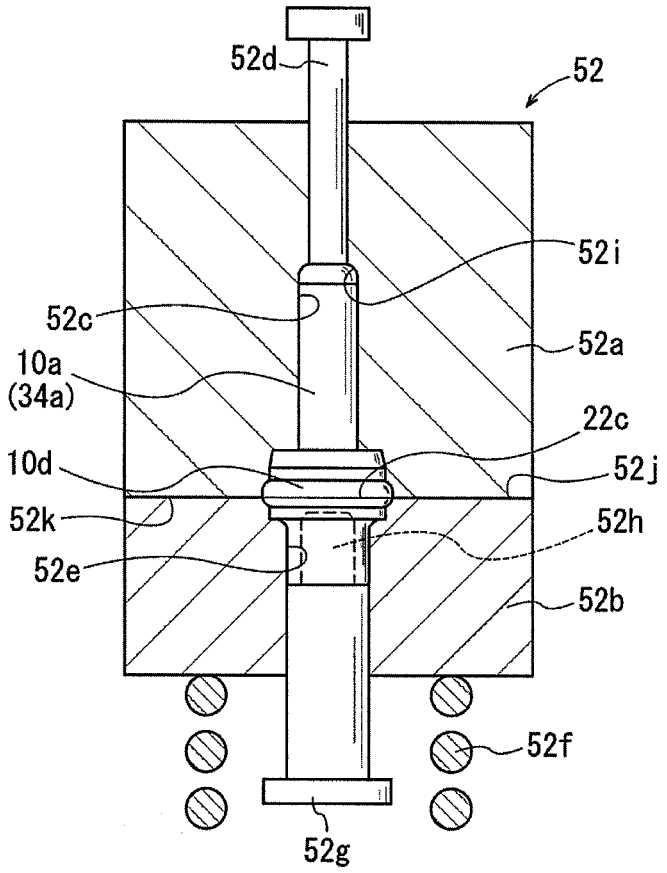
FIG. 7 is a cross-sectional view illustrating a fourth step of the manufacturing method of the embodiment.

A flange forming die 52, which includes a first die 52*a* and a second die 52*b* as shown in FIG. 7, is prepared in a fourth step. The second die 52*b* is urged toward the first die 52*a* by a pressing spring 52*f*.

Figure 8:
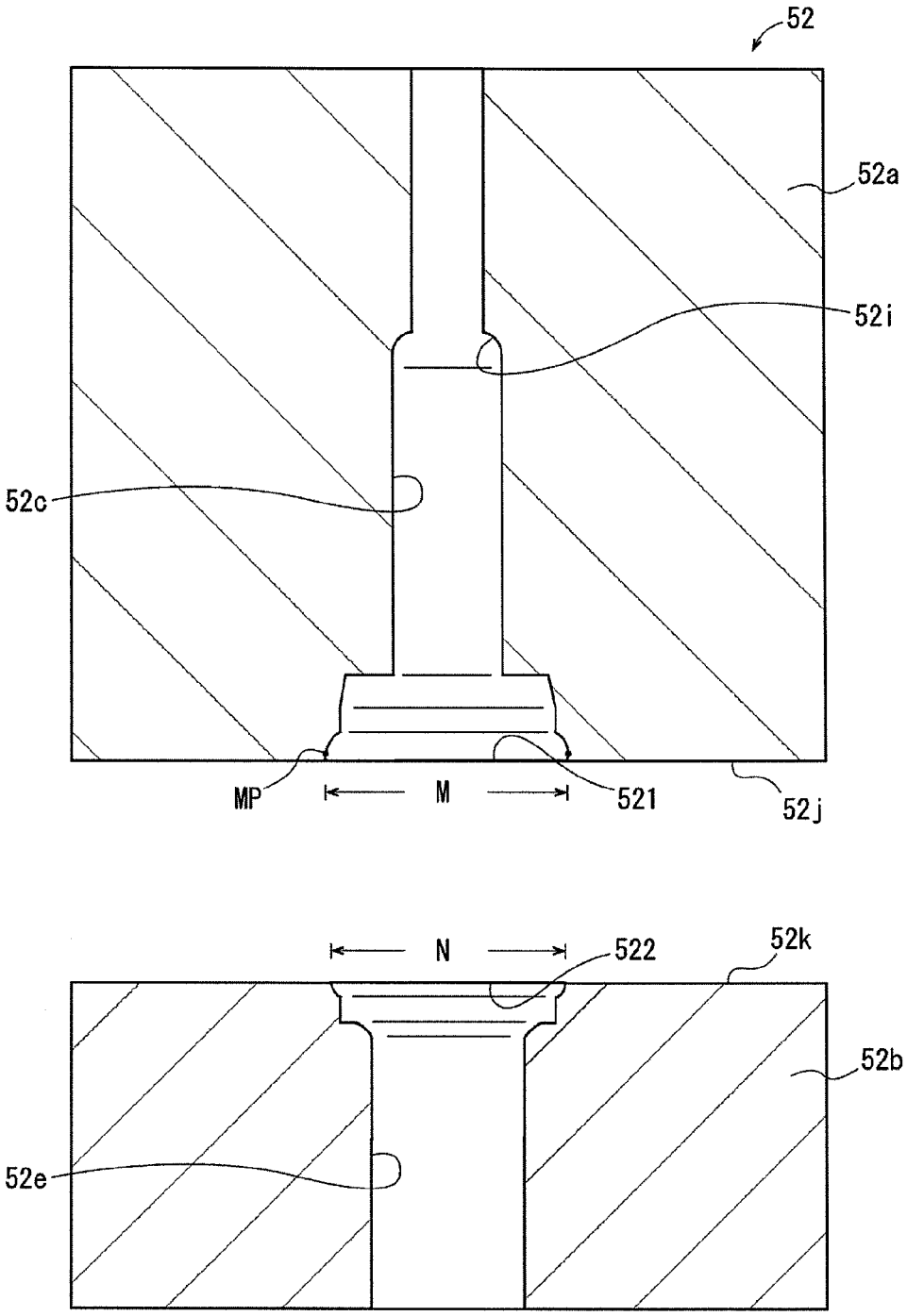
FIG. 8 is a cross-sectional view showing first and second dies used in the manufacturing method of the embodiment.

A first cavity 52*c*, which matches the small-diameter portion 10*a*, the tapered surface 20, the first cylindrical surface 21, and the first arc 22*a* of the convex curved surface 22 of the flange 10*d* shown in FIG. 2, is formed in the first die 52*a* as shown in FIG. 8. That is, a portion of the pin terminal, which is close to the rear end of the pin terminal from the first arc 22*a* of the flange 10*d*, can be formed by the first cavity 52*c*. Further, the first cavity 52*c* is formed so that the upper end of the small-diameter portion 33*a* is disposed in the first die 52*a* when the third workpiece 33 shown in FIG. 4D is disposed. Furthermore, a curved surface 52*i* is formed at the upper end of the first cavity 52*c*.

Meanwhile, a second cavity 52*e*, which matches the second cylindrical surface 23, the second arc 22*b* of the convex curved surface 22, and the large-diameter portion 10*b* of the flange 10*d* shown in FIG. 2, is formed in the second die 52*b*. That is, a portion of the pin terminal, which is close to the front end of the pin terminal from the second arc 22*b* of the flange 10*d*, can be formed by the second cavity 52*e*.

Here, as described above, the first arc 22*a* and the second arc 22*b* of the pin terminal 10 are formed on the rear and front sides of a portion, which is slightly at the side of the front end with respect to the maximum diameter position MP of the flange 10*d*, as a boundary, respectively (see FIG. 2B). That is, as shown in FIG. 8, mating surfaces 52*j* and 52*k* of the respective first and second cavities 52*c* and 52*e* of the first and second dies 52*a* and 52*b* are located at the side of the front end with respect to the maximum diameter position MP.

Further, a first round hole 521 matching the first arc 22*a* is formed on the mating surface 52*j* of the first die 52*a*. Likewise, a second round hole 522 matching the second arc 22*b* is formed on the mating surface 52*k* of the second die 52*b*. The maximum diameter N of the second round hole 522 is smaller than the maximum diameter M of the first round hole 521.

Figure 9:
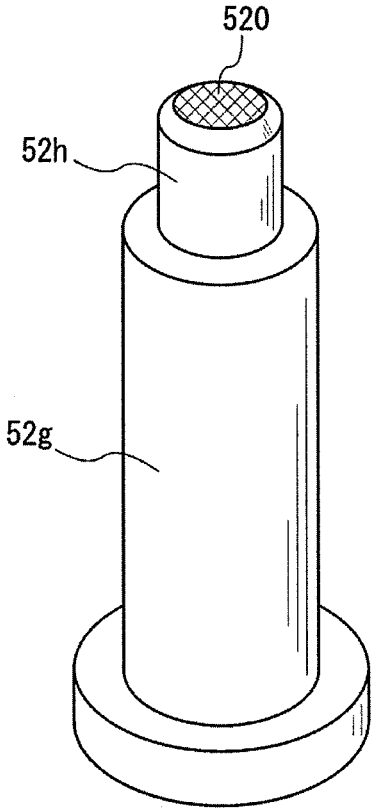
FIG. 9 is a perspective view showing a punch used in the manufacturing method of the embodiment.

Furthermore, as shown in FIG. 7, a kickout pin 52*d* is provided at the upper end of the first cavity 52*c*. Meanwhile, a punch 52*g* is provided at the lower end of the second cavity 52*e* so as to be capable of applying pressure in the second cavity 52*e*. As shown in FIG. 9, a protrusion 52*h*, which has a third height larger than the second height, is formed on the upper end surface of the punch 52*g*. The third height is a height corresponding to a third depth, and more specifically, a height from the front end of the third workpiece 33 to a position corresponding to the second cylindrical surface 23 of the flange 10*d*. The protrusion 52*h* has a tapered shape where the diameter of the protrusion 52*h* is reduced toward an upper end surface 520 of the protrusion 52*h*. Further, knurling is performed on the upper end surface 520 of the protrusion 52*h*.

Figure 4E:
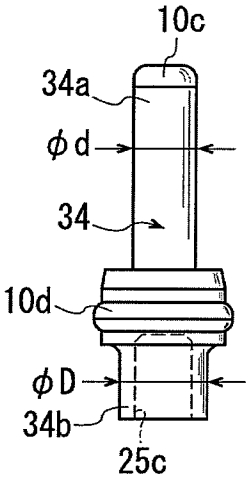

As shown in FIG. 7, the third workpiece 33 is conveyed into the first and second cavities 52*c* and 52*e* of the first and second dies 52*a* and 52*b* so that the small-diameter portion 33*a* is positioned on the upper side, that is, in the first die 52*a*, and pressure is applied to the third workpiece 33 by the punch 52*g*. Accordingly, the rear end surface of the third workpiece 33 comes into pressure contact with the kick-out pin 52*d* and the curved surface 52*i*, and the third workpiece 33 is adjusted and subjected to plastic working. In this way, the third workpiece 33 is formed into a fourth workpiece 34 as shown in FIG. 4E.

The rear end portion of the fourth workpiece 34 is a small-diameter portion 34*a* that is the same as the small-diameter portion 33*a* of the third workpiece 33. Further, the flange 10*d* is formed between a large-diameter portion 34*b*, which is the same as the large-diameter portion 33*b* of the third workpiece 33, and the small-diameter portion 34*a*. In this case, due to a difference between the maximum diameter M of the first round hole 521 of the first cavity 52*c* and the maximum diameter N of the second round hole 522 of the second cavity 52*e*, the step 22*c* is formed on the outer peripheral surface of the flange 10*d* at the portion slightly at the side of the front end with respect to the maximum diameter position MP. The step 22*c* has a shape where the step falls down toward the front end of the convex curved surface 22 (the front end of the fourth workpiece 34). Meanwhile, the end surface of the small-diameter portion 34*a* remains in the form of the curved surface 10*c*. Further, a third fitting recess 25*c*, which has a third depth larger than the second depth, is formed at the front end surface of the fourth workpiece 34 by the protrusion 52*h*.

After that, the punch 52*g* and the second die 52*b* are moved down and the fourth workpiece 34 is taken out from the flange forming die 52 by the kick-out pin 52*d*. Meanwhile, the small-diameter portion 34*a* formed at the fourth workpiece 34 corresponds to the small-diameter portion 10*a* shown in FIG. 2. Likewise, the large-diameter portion 34*b* formed at the fourth workpiece 34 corresponds to the large-diameter portion 10*b* shown in FIG. 2, and the third fitting recess 25*c* corresponds to the fitting recess 25 shown in FIG. 2.

Outer Diameter Finishing Step

After that, the outer diameter finishing step of performing cutting by a cutter or the like is performed on the outer periphery of the fourth workpiece 34. Accordingly, it is possible to improve the roundness of the outer periphery of the flange 10*d* of the fourth workpiece 34 by cutting, for example, the outer periphery of the flange 10*d*. The pin terminal 10 shown in FIG. 2 is manufactured through the outer diameter finishing step. Meanwhile, it may be possible to perform the outer diameter finishing step by performing polishing using a grinder or the like instead of the cutting performed by a cutter or the like.

Figure 10:
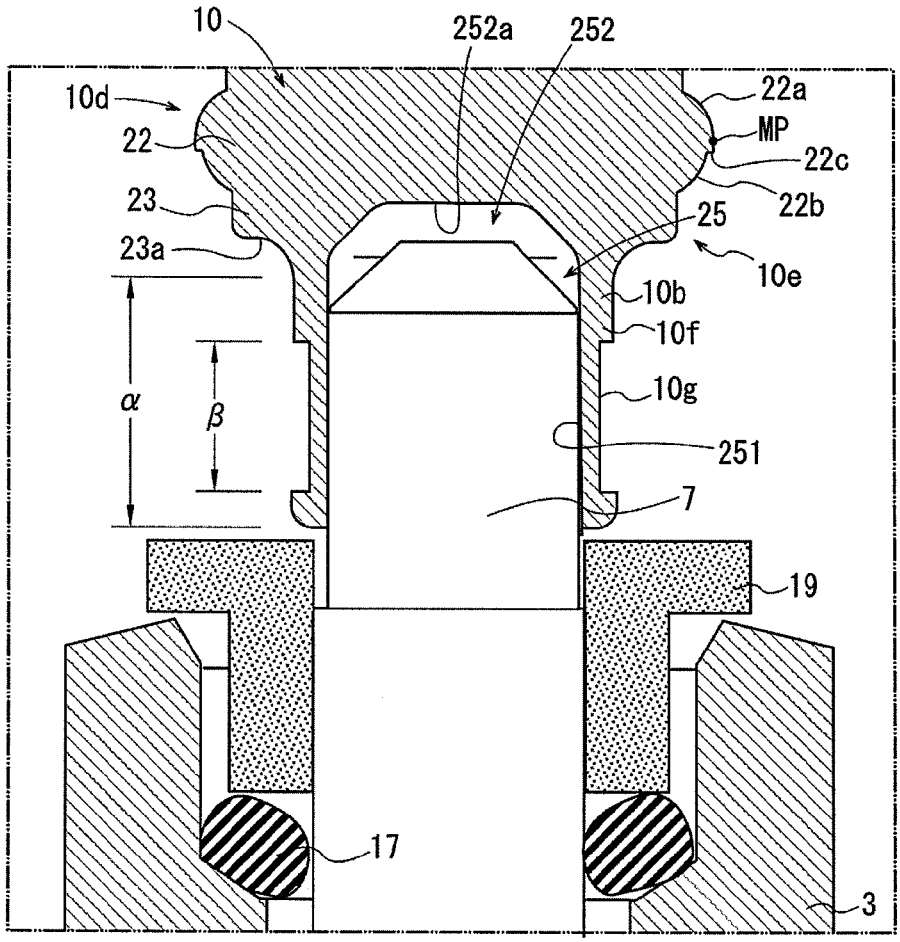
FIG. 10 is a partially enlarged cross-sectional view of the glow plug of the embodiment.

Meanwhile, the main body bracket 3, the heat generating tube 11, the insulating body 15, the heat generating coil 13, the center shaft 7, the O-ring 17, the insulator 19, and the like are prepared as shown in FIG. 1. Further, these are assembled with each other and the assembled-body is fitted to the pin terminal 10 by a commonly known method so that necessary portions of these are electrically connected to each other. In this case, while the rear end portion of the center shaft 7 is fitted to the fitting recess 25, the crimp formation region 10*f* (see FIG. 2A) of the pin terminal 10 is actually crimped at the rear end portion of the insulator 19. Accordingly, the center shaft 7 and the pin terminal 10 are jointed to each other as shown in FIGS. 1 and 10, so that assembly is completed. Further, a crimping portion 10*g* is formed on the outer peripheral surface of the large-diameter portion 10*b*, that is, the crimp formation region 10*f*. As shown in FIG. 10, the length β of the crimping portion 10*g* is set to a length that exceeds half of the overall length α of the crimp formation region 10*f* in the axial direction. Furthermore, when crimping is performed, a crimping position is adjusted so that the crimping portion 10*g* is positioned at the side of the front end with respect to the middle of the crimp formation region 10*f* in the axial direction, that is, is positioned close to the front end of the large-diameter portion 10*b* of the pin terminal 10. In this way, a glow plug is completed.

When male threads 3*c* of the main body bracket 3 are engaged with a cylinder head of a diesel engine, the heat generating portion 5*a* of the heater 5 of the glow plug, which is obtained in this way, is positioned in a combustion chamber of the diesel engine. Further, the main body bracket 3 is grounded to the cylinder head, and the cap 97*a* shown in FIG. 3 is fitted to the pin terminal 10.

When the cap 97*a* is press-fitted to the pin terminal 10 in the direction of an arrow shown in FIG. 3, the portion 971 to be locked is locked to the engagement portion 10*e*, so that the cap 97*a* is fitted to the pin terminal 10. In this state, the conductive member 87*a* is connected to the small-diameter portion 10*a*. Accordingly, electric power is supplied to the pin terminal 10, eventually, to the glow plug through the conductive member 87*a*.

Therefore, a voltage is applied between the main body bracket 3 and the pin terminal 10 and the center shaft 7, so that the heat generating portion 5*a* of the heater 5 generates heat by the heat generating coil 13. Accordingly, the diesel engine starts.

Figure 11:
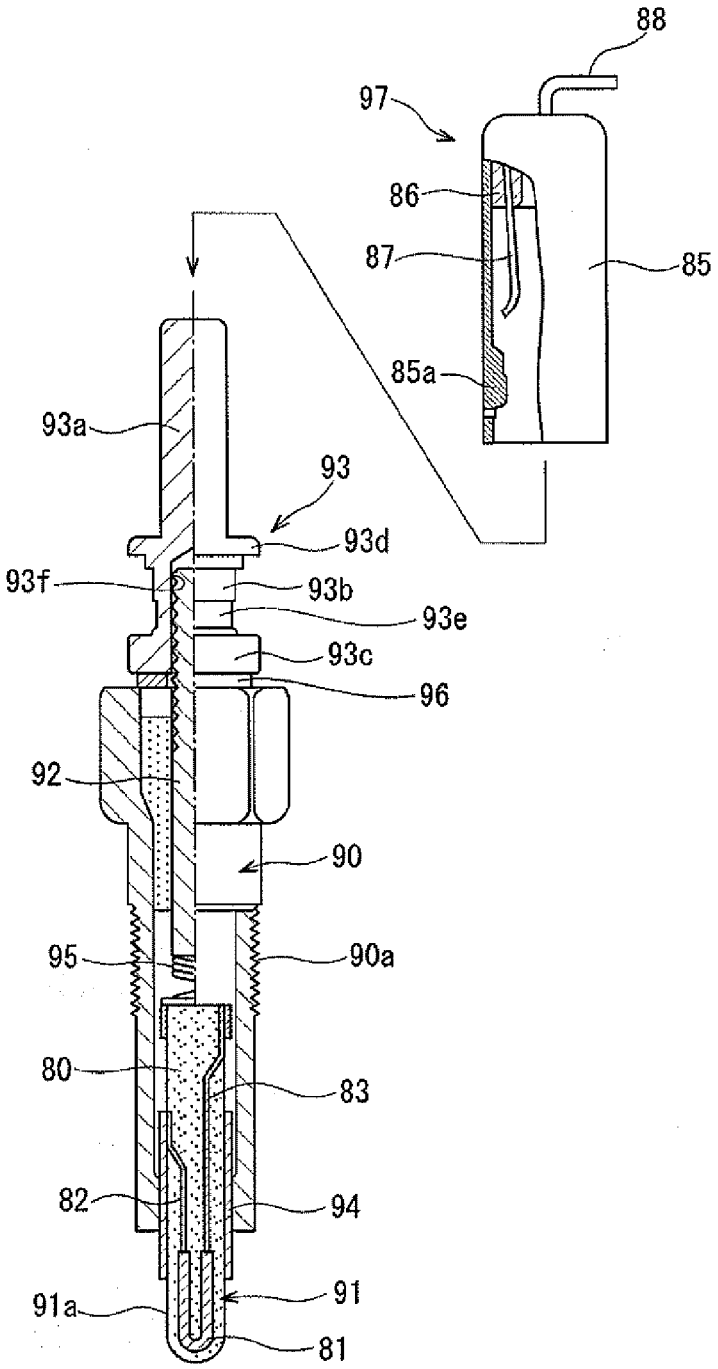
FIG. 11 is a partial cross-sectional view of a glow plug and the like in the related art.

A first flange 93*c*, which is formed at a pin terminal 93 (see FIG. 11) of a glow plug in the related art, is not formed at the front end portion of the pin terminal 10 of the glow plug. For this reason, in the glow plug, as shown in FIGS. 1 and 10, the front end surface of the pin terminal 10, that is, the front end surface of the large-diameter portion 10*b*, comes into contact with the rear end surface of the insulator 19. Accordingly, the insulator 19 is pressed. Further, in this state, the insulator 19 presses the O-ring 17 at the front end thereof. For this reason, the O-ring 17 is elastically deformed in the shaft hole 3*a*, and the O-ring 17 comes into close contact with the center shaft 7, the insulator 19, and the wall surface of the shaft hole 3*a*. In this way, an insulation effect, which is caused between the center shaft 7 and the main body bracket 3 by the O-ring 17, is sufficiently provided in the glow plug.

Further, the first flange 93*c* is not formed as described above. Accordingly, as shown in FIG. 10, in the pin terminal 10, the overall length thereof is maintained, that is, the compatibility with the cap 97 fitted to the pin terminal 10 is maintained and the length of the crimp formation region 10*f*, which is formed so as to have the even diameter and can be crimped, (the overall length α of the crimp formation region 10*f*, which corresponds to a straight portion of the large-diameter portion 10*b*, in the axial direction) is large. For this reason, the center shaft 7 and the pin terminal 10 are easily and solidly joined to each other at the long crimp formation region 10*f*, and a slightly short center shaft 7 can be employed in the glow plug. Accordingly, the glow plug including the pin terminal 10 achieves a reduction in the amount of material and weight.

Further, the length β of the crimping portion 10*g*, when crimping has been actually performed, becomes a length that exceeds half of the overall length α of the crimp formation region 10*f* in the axial direction. For this reason, in the glow plug, the joint strength between the center shaft 7 and the pin terminal 10 is high as compared to a common product (see FIG. 11) where the length of a crimping portion is equal to or smaller than half of the overall length of a crimp formation region in the axial direction. Accordingly, the glow plug reliably provides excellent durability.

Moreover, as shown in FIG. 10, the crimping portion 10*g* is positioned at the side of the front end with respect to the middle of the crimp formation region 10*f* in the axial direction. For this reason, in the glow plug, crimping is performed on the pin terminal 10 at the position that is close to the front end of the large-diameter portion 10*b*. Accordingly, in the glow plug, it is possible to reduce a load applied to the rear end portion of the center shaft 7. As a result, the durability of the glow plug is further improved.

Accordingly, the glow plug provides excellent durability through the joining between the center shaft 7 and the pin terminal 10 with high joint strength, and can achieve a reduction in the amount of material and weight.

Particularly, the diameter of the front end surface of the large-diameter portion 10*b* of the pin terminal 10 of the glow plug is smaller than the diameter of the rear end surface of the insulator 19 of the glow plug. For this reason, it is possible to very reliably prevent current from leaking to the main body bracket 3 from the pin terminal 10.

Further, as shown in FIG. 2A, the fitting recess 25 of the pin terminal 10 of the glow plug includes the inner peripheral surface 251 that extends from the front end of the large-diameter portion 10*b* toward the rear end of the large-diameter portion and the upper bottom surface 252 that continues to the rear end of the inner peripheral surface 251 and is positioned inside the pin terminal in the radial direction between the engagement portion 10*e* and the flange 10*d*. Accordingly, as shown in FIG. 10, in the glow plug, it is possible to position the rear end portion of the center shaft 7, which is fitted to the fitting recess 25, at the rear of the crimping portion 10*g* formed at the crimp formation region 10*f*. For this reason, since crimping is performed at the side of the front end with respect to the rear end portion of the center shaft 7 in the glow plug, it is possible to more effectively prevent a load from being concentrated on the rear end portion of the center shaft 7. Accordingly, the durability of the center shaft 7 itself is improved and the durability of the glow plug itself is also improved.

Furthermore, since the upper bottom surface 252 has a tapered shape where the diameter of the upper bottom surface is reduced toward the rear end and the fitting recess 25 has the third depth in the pin terminal 10, the upper bottom surface 252 is positioned in the pin terminal 10 at the position corresponding to the second cylindrical surface 23. For this reason, in the fourth step of obtaining the pin terminal 10, the thickness of the periphery of the upper bottom surface 252 is increased at the third workpiece 33 in which the third fitting recess 25*c* is formed. Accordingly, it is difficult for the upper bottom surface of the third fitting recess 25*c* (which corresponds to the upper bottom surface 252 of the fitting recess 25) to be deformed even by plastic deformation when the flange 10*d* is formed, and it is difficult for distortion or the like to occur on the upper bottom surface 252. Moreover, plastic deformation of the third workpiece 33 reaches a maximum at the maximum diameter position MP of the flange 10*d*. However, since the upper bottom surface 252 is positioned at the side of the front end with respect to the maximum diameter position MP of the flange 10*d*, it is difficult for the deformation of the upper bottom surface 252, which is caused by plastic deformation, to occur on the obtained fourth workpiece 34. For these reasons, it is difficult for distortion or wrinkles or the like, which is generated by the distortion, to occur on the upper bottom surface 252 in the fourth workpiece 34, so that it is difficult for cleaning liquid or the like used during plating to remain on the upper bottom surface 252. Accordingly, plating is preferably performed on the fitting recess 25 in the pin terminal 10. Further, it is difficult for rust or the like to occur on the upper bottom surface 252 in the pin terminal 10.

Further, since knurling is performed on the upper end surface 520 of the protrusion 52*h* of the punch 52*g*, it is difficult for the protrusion 52*h* to slide in the second fitting recess 25*b* when pressure is applied to the third workpiece 33 by the punch 52*g*. Accordingly, it is possible to preferably form the third fitting recess 25*c*. For these reasons, the pin terminal 10 has high quality, and the quality of the glow plug eventually becomes high.

Furthermore, in the glow plug, the center shaft 7 has a tapered rear end portion having the diameter reduced toward the rear end and the rear end portion of the center shaft 7 is positioned inside the upper bottom surface 252. For this reason, when the pin terminal 10 and the center shaft 7 are assembled, the rear end of the center shaft 7 is easily inserted into the fitting recess 25 since the rear end portion of the center shaft 7 has the above-mentioned tapered shape. Moreover, the rear end of the center shaft 7 inserted into the fitting recess 25 reaches the upper bottom surface 252 along the inner peripheral surface 251. Accordingly, it is possible to preferably join the center shaft 7 to the pin terminal 10 with high joint strength so that the rear end portion of the center shaft 7 is positioned inside the upper bottom surface 252. For this reason, the durability of the glow plug is improved.

In addition, since the upper bottom surface 252 is positioned in the pin terminal 10 at the position corresponding to the second cylindrical surface 23 as described above, the depth of the fitting recess 25 is relatively small. For this reason, it is possible to make the rear end of the center shaft 7 short. Accordingly, the whole center shaft 7 can be formed to be short in the glow plug, so that it is possible to reduce the manufacturing cost of the glow plug. Meanwhile, even though the depth of the fitting recess 25 is reduced and the rear end of the center shaft 7 becomes short as described above, the joint strength between the center shaft 7 and the pin terminal 10 is maintained high since the length β of the crimping portion 10*g* is a sufficient length as shown in FIG. 10.

Further, the flange 10*d* includes the first cylindrical surface 21, the convex curved surface 22, and the second cylindrical surface 23. Furthermore, the flange 10*d* includes the first disc surface 21*a*, the tapered surface 20 that is connected to the first disc surface 21*a* and the first cylindrical surface 21, and the second disc surface 23*a* that is connected to the second cylindrical surface 23 and the large-diameter portion 10*b*. In addition, the step 22*c* is formed on the outer peripheral surface of the convex curved surface 22 of the flange 10*d* at the position slightly at the side of the front end with respect to the maximum diameter position MP.

For these reasons, the cap 97*a* is easily fitted to the pin terminal 10 and it is difficult for the cap 97*a*, which is locked to the engagement portion 10*e*, to be taken out from the pin terminal 10. Specifically, since the cap 97*a* is mounted on the pin terminal 10 while the cap 97*a* is press-fitted in the direction of the arrow shown in FIG. 3, the portion 971 to be locked of the cap main body 970 is elastically deformed so as to expand along the first disc surface 21*a* and the tapered surface 20 and reaches the convex curved surface 22. Further, the portion 971 to be locked is elastically deformed so as to further expand along the first arc 22*a* and reaches the maximum diameter position MP. While the portion 971 to be locked is elastically deformed so as to contract along the step 22*c* and the second arc 22*b* after passing the maximum diameter position MP, the portion 971 to be locked reaches the engagement portion 10*e*. Furthermore, the portion 971 to be locked is locked to the second cylindrical surface 23. Since the mounting direction of the cap 97*a* on the pin terminal 10 is along the tapered surface 20 and the first arc 22*a* as described above, it is possible to easily fit the cap 97*a* to the pin terminal 10.

Meanwhile, even though the portion 971 to be locked is deviated from the second cylindrical surface 23 due to the vibration and the like of a diesel engine and is moved in the direction where the cap 97*a* is taken out from the pin terminal 10, that is, the direction opposite to the arrow shown in FIG. 3, the portion 971 to be locked is caught by the step 22*c* and is locked to the step 22*c* as it is. Accordingly, for example, even though the engagement of the portion 971 to be locked caused by the second cylindrical surface 23 is released and the portion 971 to be locked is elastically deformed so as to expand along the second arc 22*b*, the portion 971 to be locked comes into contact with the step 22*c*. For this reason, the portion 971 to be locked does not expand larger than the second arc 22*b* and cannot reach the first arc 22*a* beyond the step 22*c*. As a result, the portion 971 to be locked is locked to the step 22*c*. Since the cap 97*a* is doubly locked by the second cylindrical surface 23 and the step 22*c* in the glow plug as described above, it is possible to more preferably fit the cap 97*a* to the pin terminal 10.

In addition, in the fourth step, the step 22*c* is formed using a difference between the maximum diameter M of the first round hole 521 of the first cavity 52*c* and the maximum diameter N of the second round hole 522 of the second cavity 52*e*. For this reason, it is possible to suppress the generation of swarf of the fourth workpiece 34 as compared to, for example, the case where the step 22*c* is formed by cutting the entire outer peripheral surface of the convex curved surface 22.

The embodiment of the invention has been described above. However, the invention is not limited to the above-mentioned embodiment, and it goes without saying that the invention may be appropriately modified without departing from the scope of the invention.

For example, a housing made of a resin may be employed in the glow plug instead of the main body bracket 3.

Further, the heat generating tube 11, the insulating powder 12, and the heat generating coil 13 have been used as the heater 5 in the above-mentioned embodiment. However, a ceramic heater may be used as the heater.

Furthermore, as described above, the step 22, the second cylindrical surface 23, and the second disc surface 23*a* form the engagement portion 10*e*, and the portion 971 to be locked may be locked by these. In this case, it is more difficult for the portion 971, which is to be locked, to be taken out from the engagement portion 10*e*, so that it is more difficult for the cap 97*a* to be taken out from the pin terminal 10*e*.

Moreover, the punches 50*c* and 51*c* may have the same structure as the structure of the punch 52*g* except for the lengths of the protrusions 50*d* and 51*d*. In this case, even when the first and second fitting recesses 25*a* and 25*b* are formed, it is difficult for the protrusions 50*d* and 51*d* to slide on the first and second workpieces 31 and 32 due to knurling that is performed on each of the upper end surfaces of the protrusions 50*d* and 51*d*. Accordingly, it is possible to preferably form the first and second fitting recesses 25*a* and 25*b*.

In addition, the step 22*c* may not be formed by the plastic working of the fourth step and may be formed by cutting when an outline finishing step is performed on the fourth workpiece 34.

REFERENCE SIGNS LIST

87: conductive member
10*a*: small-diameter portion
10*d*: flange
25: fitting recess
10*b*: large-diameter portion
MP: maximum diameter position
10*e*: engagement portion
10: pin terminal
10*f*: crimp formation region
19: insulator (insulating member)
251: inner peripheral surface
252: upper bottom surface
3: main body bracket (housing)
5*a*: heat generating portion
5: heater
7: center shaft
17: O-ring
10*g*: crimping portion
251: inner peripheral surface
252: upper bottom surface
21: first cylindrical surface
22: convex curved surface
23: second cylindrical surface
22*c*: step
21*a*: first disc surface
20: tapered surface
23*a*: second disc surface

The invention claimed is:

1. A pin terminal for a glow plug comprising:

a small-diameter portion which has a shaft shape extending in an axial direction and is to be connected to a conductive member for supplying electric power from an outside;

a flange that is formed integrally with a front end of the small-diameter portion and is formed so as to have an outer diameter larger than an outer diameter of the small-diameter portion;

a cylindrical large-diameter portion that is formed integrally with a front end of the flange so as to be shorter than the small-diameter portion in the axial direction, is formed so as to have an outer diameter larger than the outer diameter of the small-diameter portion and smaller than the outer diameter of the flange, and includes a fitting recess formed therein in a radial direction so as to be recessed toward a rear end of the large-diameter portion from a front end of the large-diameter portion in the axial direction; and an engagement portion which is positioned between a maximum diameter position of the flange and the large-diameter portion and has an outer diameter gradually reduced toward the large-diameter portion, wherein the large-diameter portion includes a crimp formation region which is formed in a range from a front end of the large-diameter portion to a front end of the engagement portion so as to have an even outer diameter and be capable of being crimped, wherein the flange includes a convex curved surface, said convex curved surface, when taken in cross-section in a direction perpendicular to the axial direction, having a circular shape, and wherein a step is formed on the convex curved surface at a side of the cylindrical large-diameter portion with respect to the maximum diameter position, said step configured to inhibit an elastically deformable sleeve that is slidable over the pin terminal from sliding off.

2. The pin terminal according to claim 1, wherein a diameter of a front end surface of the large-diameter portion, is dimensioned to engage a rear end surface of an insulating member.

3. The pin terminal according to claim 1, wherein the fitting recess includes an inner peripheral surface that extends from the front end of the large-diameter portion toward the rear end of the large-diameter portion, and an upper bottom surface that continues to a rear end of the inner peripheral surface and is positioned inside the engagement portion or the flange in a radial direction of the engagement portion or the flange.

4. The pin terminal according to claim 3, wherein the upper bottom surface has a tapered shape where a diameter of the upper bottom surface is reduced toward a rear end thereof.

5. The pin terminal according to claim 4, wherein the upper bottom surface is positioned at a side of the front end of the flange with respect to the maximum diameter position of the flange.

6. The pin terminal according to claim 1, wherein the flange includes a first cylindrical surface that is positioned close to the small-diameter portion and has a diameter larger than the diameter of the small-diameter portion, the convex curved surface being connected to the first cylindrical surface and of which a cross-section in the axial direction forms an arc, and a second cylindrical surface that is connected to the convex curved surface and has the same diameter as the diameter of the first cylindrical surface.

7. The pin terminal according to claim 6, wherein the flange includes a first disc surface that is connected to the small-diameter portion, a tapered surface which is connected to the first disc surface and is tapered toward a rear end side thereof, and a second disc surface that connects the second disc surface to the large-diameter portion and extends in the direction perpendicular to the axial direction.

8. A glow plug comprising:

a cylindrical housing;

a heater that is fixed in the housing and includes a heat generating portion protruding from a front end of the housing;

a rod-like center shaft which is disposed in the housing and includes a rear end portion protruding from a rear end of the housing;

an insulating member which is provided at the rear end of the housing and into which the center shaft is inserted; and a pin terminal that is fitted to the rear end portion of the center shaft and used for supplying electricity to the heat generating portion from an outside through the center shaft, wherein the pin terminal includes:

a small-diameter portion which has a shaft shape extending in an axial direction and is to be connected to a conductive member for supplying electric power from the outside;

a flange that is formed integrally with a front end of the small-diameter portion and is formed so as to have an outer diameter larger than an outer diameter of the small-diameter portion;

a cylindrical large-diameter portion that is formed integrally with a front end of the flange so as to be shorter than the small-diameter portion in the axial direction, is formed so as to have an outer diameter larger than the outer diameter of the small-diameter portion and smaller than the outer diameter of the flange, and includes a fitting recess formed therein in a radial direction so as to be recessed toward a rear end of the large-diameter portion from a front end of the large-diameter portion in the axial direction; and an engagement portion which is positioned between a maximum diameter position of the flange and the large-diameter portion and has an outer diameter gradually reduced toward the large-diameter portion, wherein the large-diameter portion includes a crimp formation region which is formed in a range from a front end of the large-diameter portion to a front end of the engagement portion so as to have an even outer diameter and be capable of being crimped, wherein a part of the crimp formation region forms a crimping portion that fixes the rear end portion of the center shaft by crimping, wherein the flange includes a convex curved surface, said convex curved surface, when taken in cross-section in a direction perpendicular to the axial direction, having a circular shape, and wherein a step is formed on the convex curved surface at a side of the cylindrical large-diameter portion with respect to the maximum diameter position, said step configured to inhibit an elastically deformable sleeve that is slidable over the pin terminal from sliding off.

9. The glow plug according to claim 8, wherein the crimping portion has a length that exceeds a half of an overall length of the crimp formation region in the axial direction.

10. The glow plug according to claim 9, wherein the crimping portion is positioned at a side of a front end of the crimp formation region with respect to a middle of the crimp formation region in the axial direction.

11. The glow plug according to claim 8, wherein the fitting recess includes an inner peripheral surface that extends from a front end of the large-diameter portion toward a rear end of the large-diameter portion, and an upper bottom surface that continues to a rear end of the inner peripheral surface and is positioned inside the engagement portion or the flange in a radial direction of the engagement portion or the flange, the upper bottom surface has a tapered shape where a diameter of the upper bottom surface is reduced toward a rear end, the center shaft has a tapered rear end portion having a diameter reduced toward a rear end, and the rear end portion of the center shaft is positioned inside the upper bottom surface.

12. The glow plug according to claim 11, wherein the upper bottom surface is positioned at the side of the front end with respect to the maximum diameter position of the flange.

* * * * *